US010049834B1

(12) United States Patent
Lin

(10) Patent No.: US 10,049,834 B1
(45) Date of Patent: Aug. 14, 2018

(54) KEYBOARD HAVING TRANSVERSELY MOVEABLE BOARD ACTIVATED BY KEY PRESSING

(71) Applicant: Shih-Pin Lin, Taichung (TW)

(72) Inventor: Shih-Pin Lin, Taichung (TW)

(73) Assignee: Sunrex Technology Corp., Taichung (TW)

( * ) Notice: Subject to any disclaimer, the term of this patent is extended or adjusted under 35 U.S.C. 154(b) by 0 days.

(21) Appl. No.: 15/640,771

(22) Filed: Jul. 3, 2017

(51) Int. Cl.
*H01H 13/705* (2006.01)
*H01H 3/12* (2006.01)

(52) U.S. Cl.
CPC ..... *H01H 13/705* (2013.01); *H01H 3/125* (2013.01); *H01H 2215/004* (2013.01)

(58) Field of Classification Search
CPC ..... H01H 13/705; H01H 3/125; H01H 2215/004; H01H 2215/012; H01H 13/83; H01H 2209/038; H01H 2209/082; H01H 2219/062; H01H 2221/07; H01H 2229/036; H01H 2219/056
USPC ..... 200/5 A, 314, 344, 512, 517
See application file for complete search history.

(56) References Cited

U.S. PATENT DOCUMENTS 6,288,353 B1 * 9/2001 Chiang ..... H01H 3/125 200/344
7,608,792 B1 * 10/2009 Tsai ..... H01H 13/83 200/310
8,247,714 B2 * 8/2012 Tsai ..... H01H 3/125 200/314
8,957,337 B2 * 2/2015 Niu ..... H01H 3/125 200/344

* cited by examiner

*Primary Examiner* — Edwin A. Leon

(57) ABSTRACT

A keyboard includes a base board; transversely moveable boards, each moveably provided on the base board and including a film circuit board, a resilient dome on the film circuit board, a hole member on the film circuit board and adjacent to the resilient dome, openings on the film circuit board, a hollow structure in the film circuit board and directly under the resilient dome, a top contact in the hollow structure, and a bottom contact in the hollow structure and spaced from the top contact; key caps; and scissors-type bridge structures, each including a first frame member, a hollow, rectangular second frame member, and a peg extending out of the first frame member. Top of the scissors-type bridge structure is pivotably secured to the key cap. Bottom of the scissors-type bridge structure is pivotably secured to the base board by inserting through the holes onto the base board.

6 Claims, 8 Drawing Sheets

KEYBOARD HAVING TRANSVERSELY MOVEABLE BOARD ACTIVATED BY KEY PRESSING

BACKGROUND OF THE INVENTION

1. Field of the Invention

The invention relates to keyboards and more particularly to a keyboard having a transversely moveable board configured to be activated by key pressing so as to increase the key stroke.

2. Description of Related Art

Keyboards are main input devices of computer or the like. For example, Taiwan Utility Model Number M509969 discloses a keyboard having a plurality keys each being capable of sending a key press signal in response to force exerted thereon.

However, the prior art suffers from a number of drawbacks due to the provision of stem under the key. In detail, the keys are bulky rather than being compact, thin. The key cap may deflect to either right or left (i.e., oblique) after a period of time of use. Thus, a correct key press signal cannot be generated in response to a key press and a subsequent downward movement of the stem.

Thus, the need for improvement still exists.

SUMMARY OF THE INVENTION

It is therefore one object of the invention to provide a keyboard comprising a base board; a plurality of transversely moveable boards, each transversely moveable board being moveably provided on the base board and including a film circuit board, a resilient dome on the film circuit board, a hole member on the film circuit board and adjacent to the resilient dome, a plurality of elongated openings on the film circuit board, a hollow structure in the film circuit board and directly under the resilient dome, a top contact in the hollow structure, and a bottom contact in the hollow structure and spaced from the top contact; a plurality of key caps, each key cap being square and configured to be depressed; and a plurality of scissors-type bridge structures, each scissors-type bridge structure including a first frame member, a hollow, rectangular second frame member, and a peg extending out of the first frame member wherein a top of the scissors-type bridge structure is pivotably secured to the key cap, and a bottom of the scissors-type bridge structure is pivotably secured to the base board by inserting through the elongated holes onto the base board; wherein in an inoperative state and a first position of the transversely moveable board, the peg is disposed on the resilient dome; and wherein in an operative state by pressing the key cap, the peg presses and moves along the resilient dome to fall into the hole member to cause the transversely moveable board to dispose in a second position.

The above and other objects, features and advantages of the invention will become apparent from the following detailed description taken with the accompanying drawings.

DETAILED DESCRIPTION OF THE INVENTION

Figure 1:
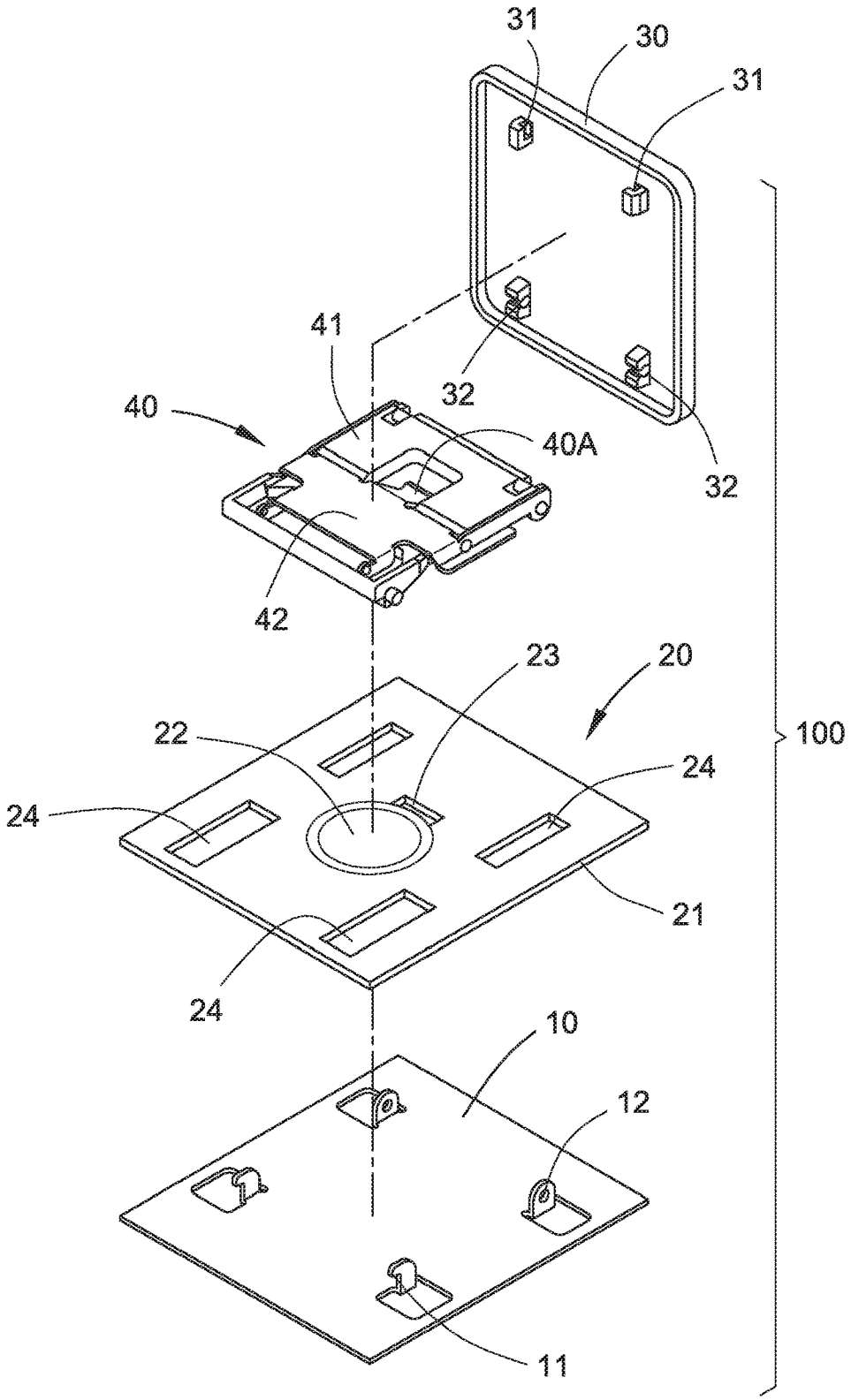
FIG. 1 is an exploded view of a unit of a keyboard according to a first preferred embodiment of the invention.
Figure 2:
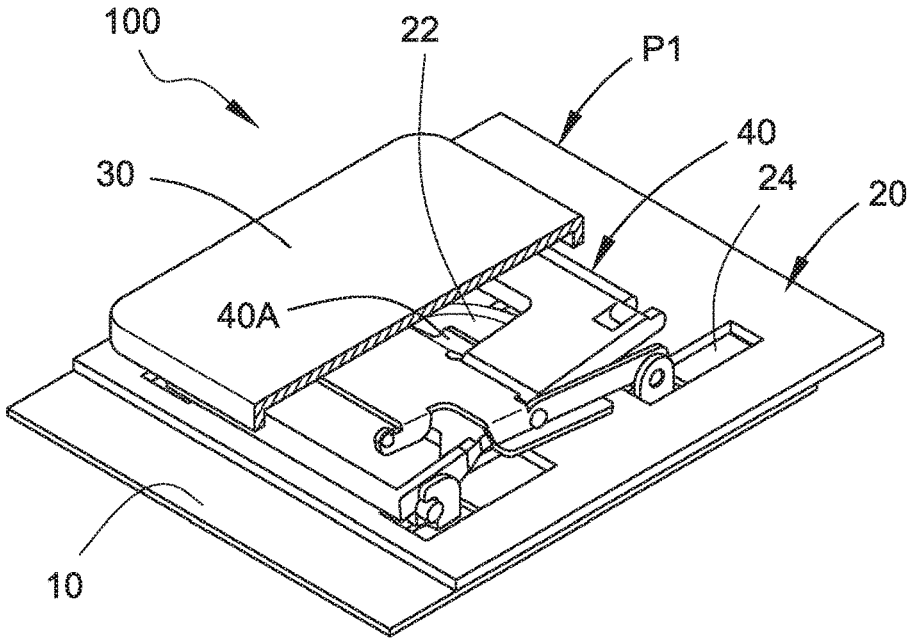
FIG. 2 is a fragmentary view of the assembled unit of keyboard.
Figure 3:
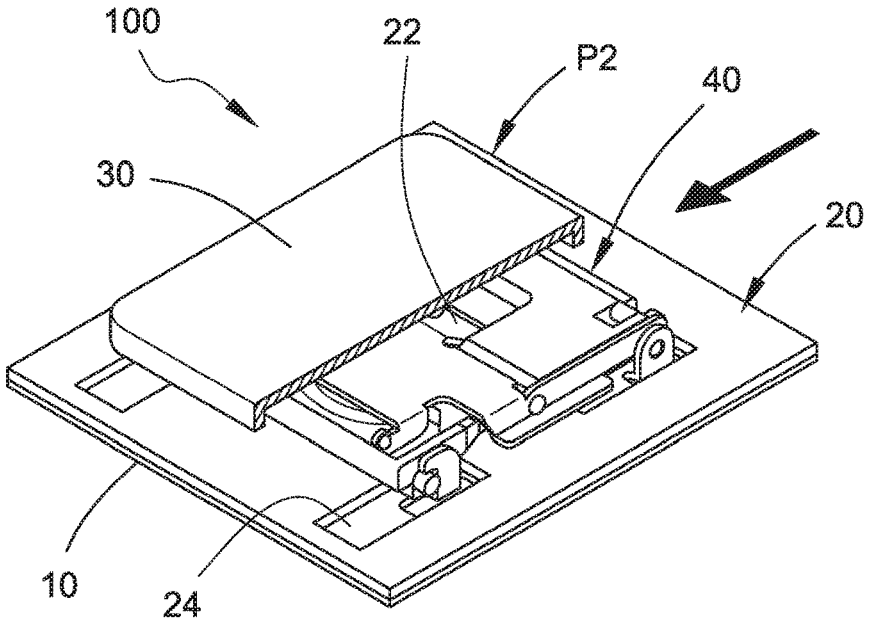
FIG. 3 is a view similar to FIG. 2 showing a transverse movement of the transversely moveable board by pressing a key cap.
Figure 4:
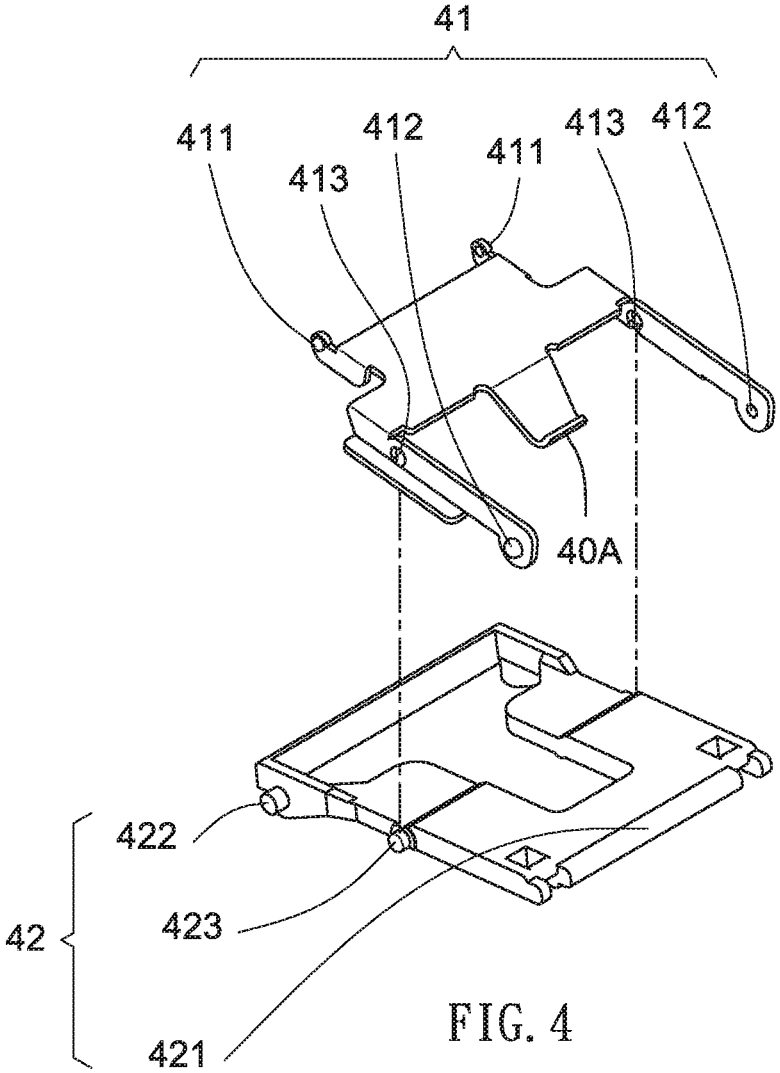
FIG. 4 is an exploded view of the scissors-type bridge structure.
Figure 5A:
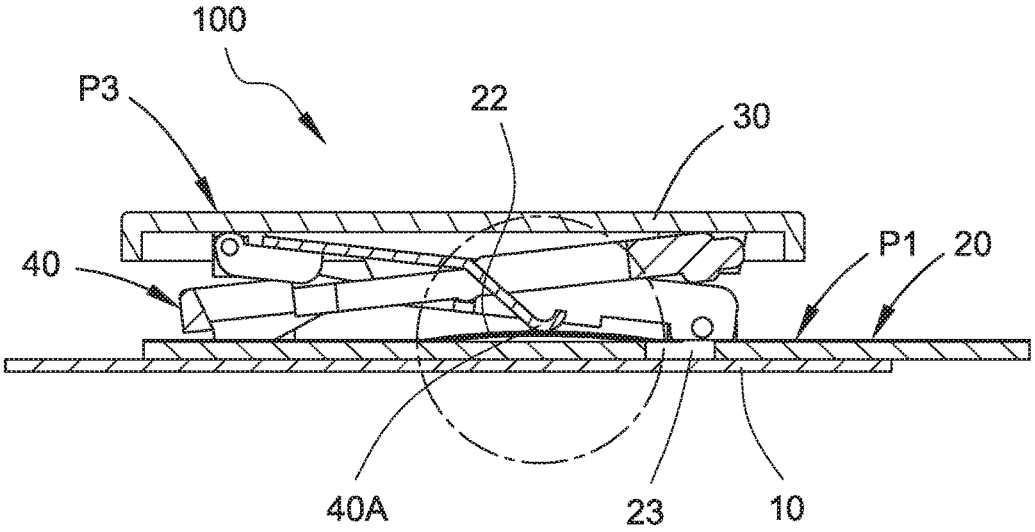
FIG. 5A is a longitudinal sectional view of FIG. 2.
Figure 5B:
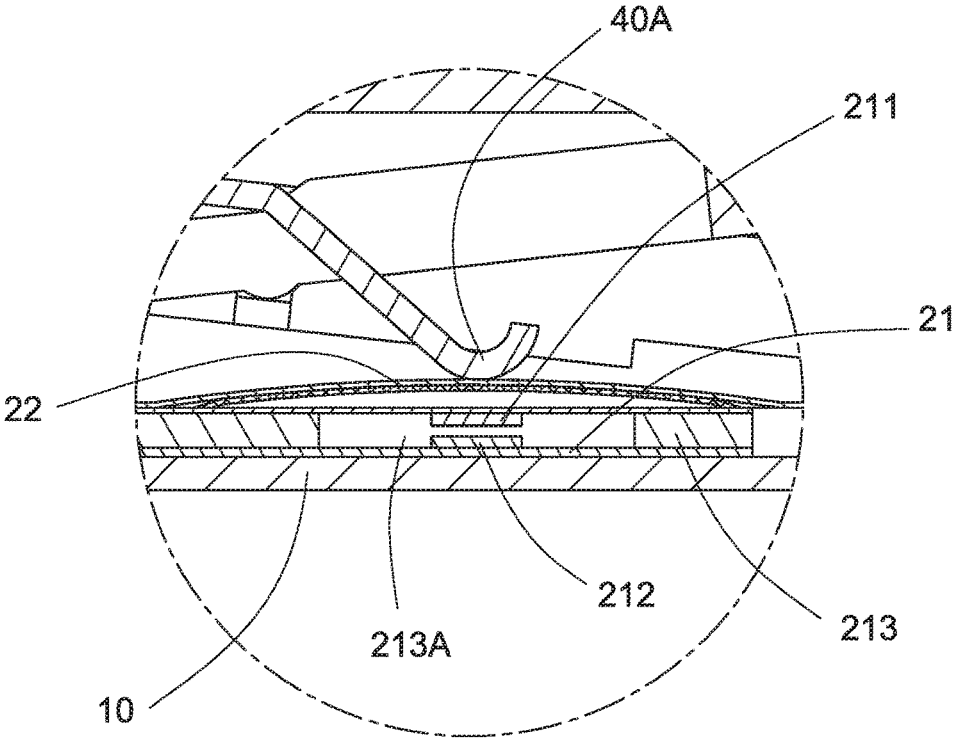
FIG. 5B is an enlarged view of an circle in FIG. 5A.

Referring to FIGS. 1 to 7, a keyboard 100 in accordance with a first preferred embodiment of the invention comprises, from top to bottom, a plurality of key caps 30 (one is shown), a plurality of scissors-type bridge structures 40 (one is shown), a plurality of transversely moveable boards 20 (one is shown), and a base board 10 (a unit thereof is shown). Each component is discussed in detail below.

The unit of the base board 10 includes two opposite slide guide grooves 11 and two opposite snapping grooves 12 together forming a virtual square. The transversely moveable board 20 is moveably provided on the base board 10 and includes a film circuit board 21, a resilient dome 22 made of metal on a central portion of the film circuit board 21, a hole member 23 on the film circuit board 21 and adjacent to the resilient dome 22, and a plurality of (four are shown) elongated openings 24 on the film circuit board 21 and together forming a virtual square. A hollow structure 213 is formed in the film circuit board 21 and directly under the resilient dome 22. A space 213A is formed in the hollow structure 213. A top contact 211 and a bottom contact 212 spaced from the top contact 211 are provided in the hollow structure 213.

Figure 6A:
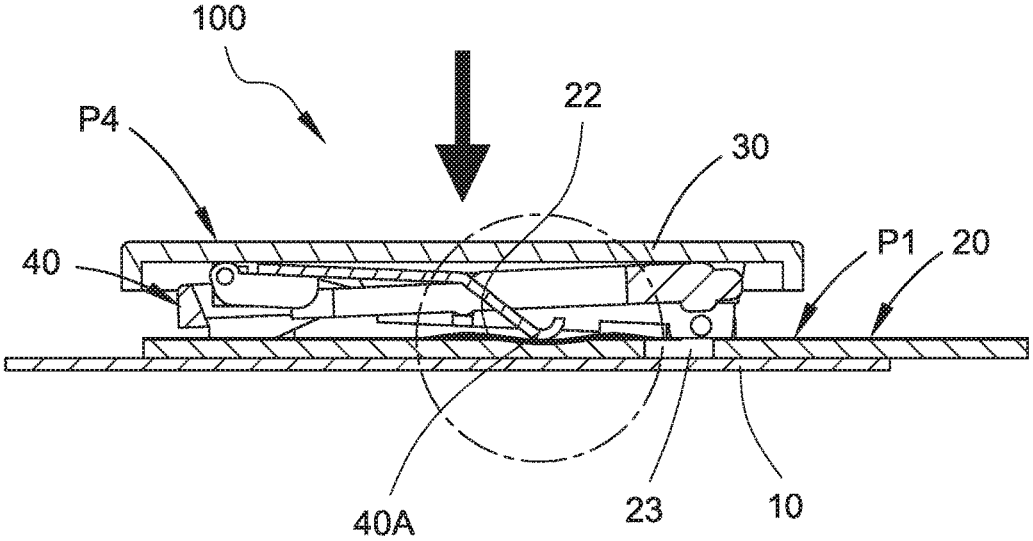
FIG. 6A is a longitudinal sectional view of FIG. 3.
Figure 6B:
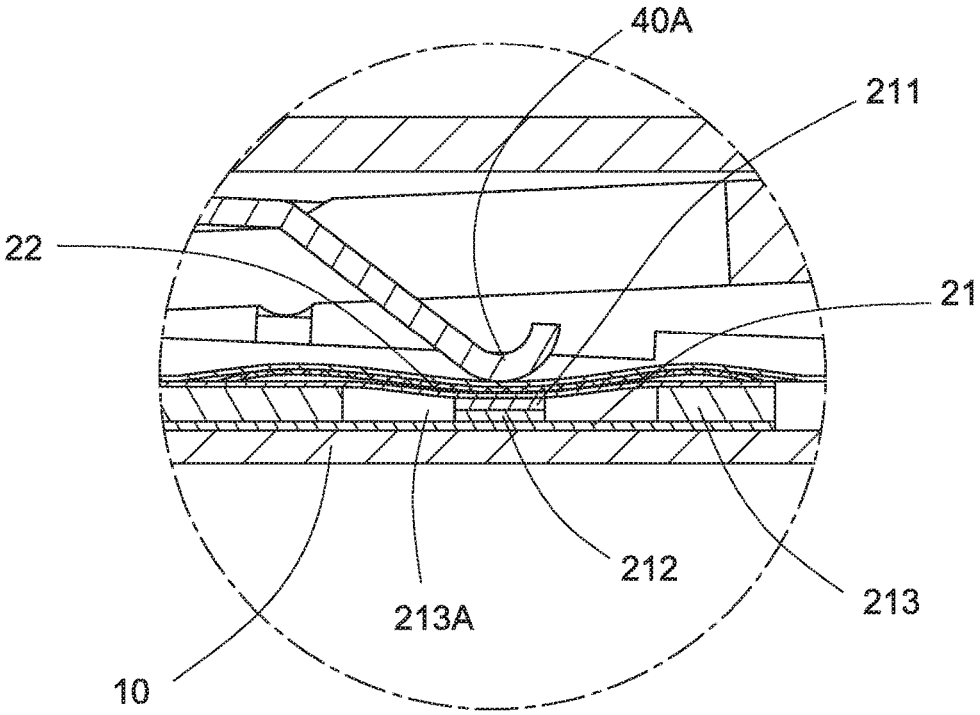
FIG. 6B is an enlarged view of an circle in FIG. 6A.
Figure 7:
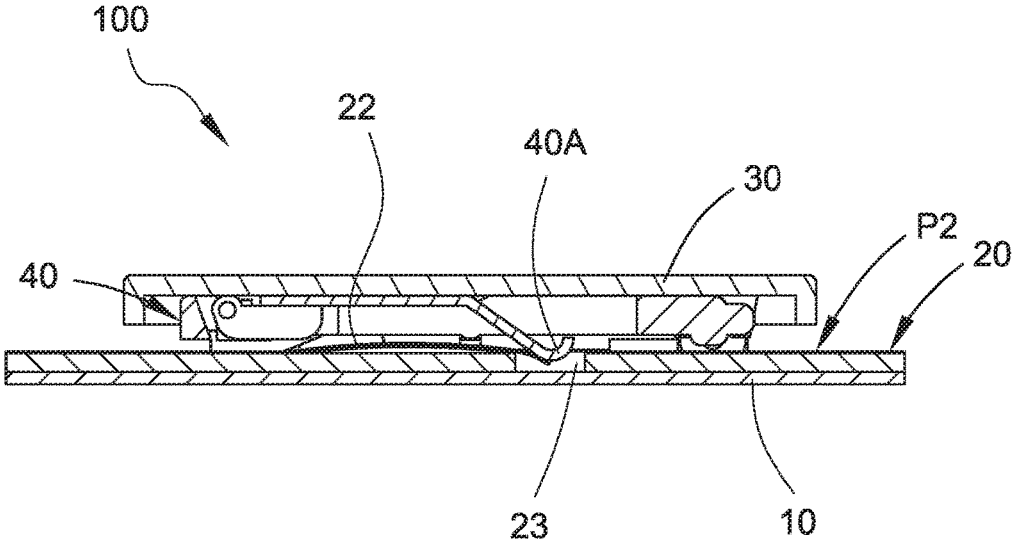
FIG. 7 is a longitudinal sectional view of the assembled unit of keyboard at the end of the key pressing operation.

The key cap 30 is square and is configured to be depressed. The key cap 30 includes two opposite slide guide grooves 31 on an underside and two pivot grooves 32 on an underside and together forming a virtual square. The scissors-type bridge structure 40 includes a first frame member 41 and a hollow, rectangular second frame member 42. The first frame member 41 has a central peg 40A on the resilient dome 22 and aligned with both the top contact 211 and the bottom contact 212, two first pivots 411 at two corners respectively and pivotably fastened in the slide guide grooves 31 respectively, two second pivots 412 at two other corners respectively and pivotably fastened in the snapping grooves 12 respectively by inserting through the two openings 24, and two holes 413 at intermediate portions of two sides respectively. The second frame member 42 has a pivot shaft 421 at one end and pivotably mounted between pivot grooves 32, two third pivots 422 at two corners of the other end respectively and pivotably mounted in the slide guide grooves 11 respectively by inserting through the other two openings 24, and two fourth pivots 423 at intermediate portions of two sides respectively and pivotably mounted in the holes 413 respectively In an inoperative state, the transversely moveable board 20 is disposed in a first position indicated by P1 and the key cap 30 is in a third position indicated by P3 (see FIGS. 5A and 5B). As shown in FIGS. 6A and 6B, in response to pressing the key cap 30, the resilient dome 22 is depressed by the peg 40A because the force exerted by the finger on the key cap 30 is transmitted to the resilient dome 22. The depressed resilient dome 22 presses the hollow structure 213 to engage the top contact 211 with the bottom contact 212, thereby generating a key press signal. The transversely moveable board 20 is disposed in the first position P1 and the key cap 30 is in a fourth position indicated by P4. As shown in FIG. 7, the transversely moveable board 20 moves transversely with respect to the base board 10 to a second position indicated by P2. At the end of key pressing operation, the peg 40 is disposed in the hole member 23. After releasing the key cap 30, the key cap 30 returns to the first position P1 (see FIG. 5A) from the second position P2.

It is envisaged by the invention that an additional increase of stroke of a key (i.e., key cap 30) between an inoperative state (i.e., the first position P1) to an operative state (i.e., the second position P2) is made possible.

Figure 8A:
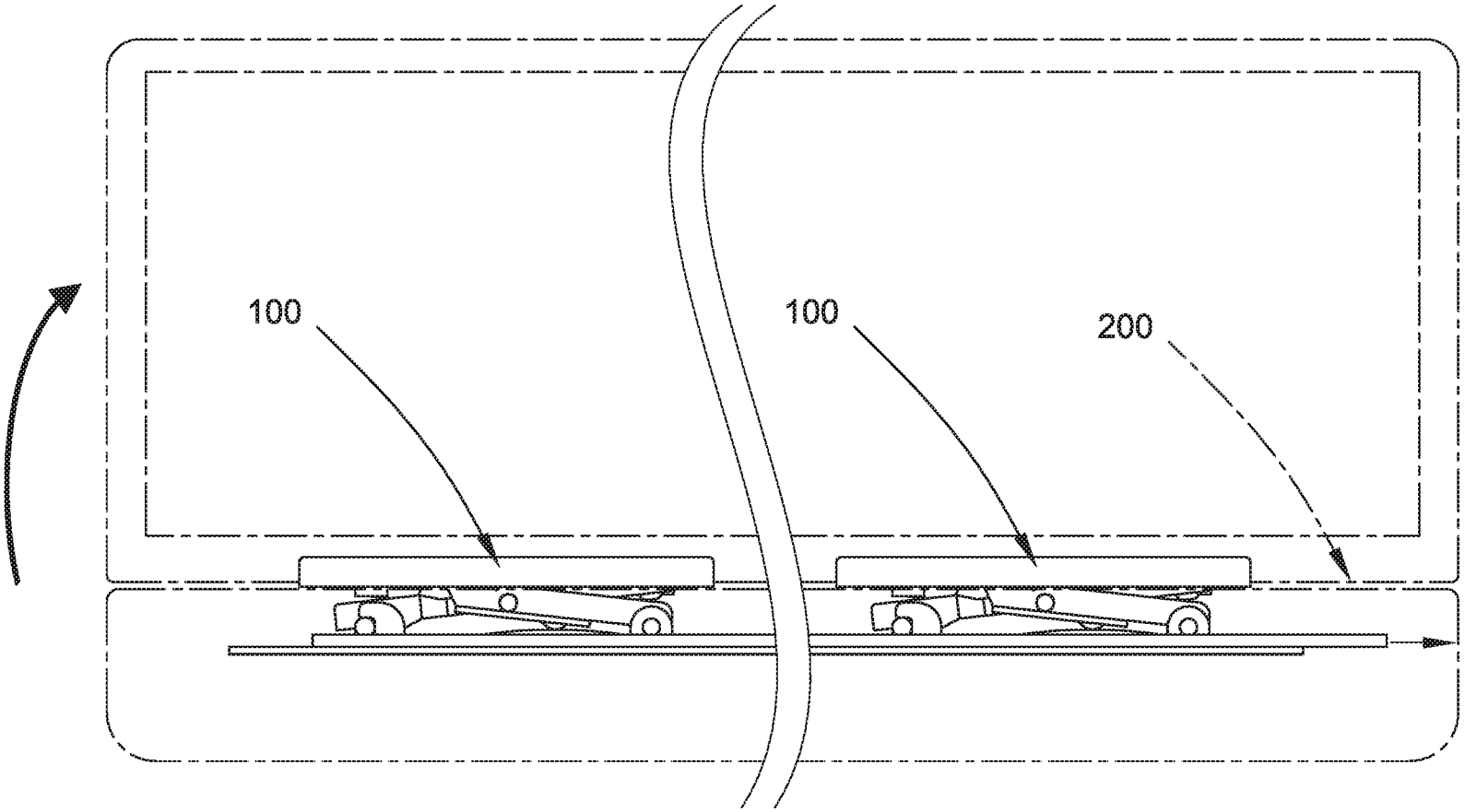
FIG. 8A schematically shows an open laptop having a keyboard according to a second preferred embodiment of the invention.
Figure 8B:
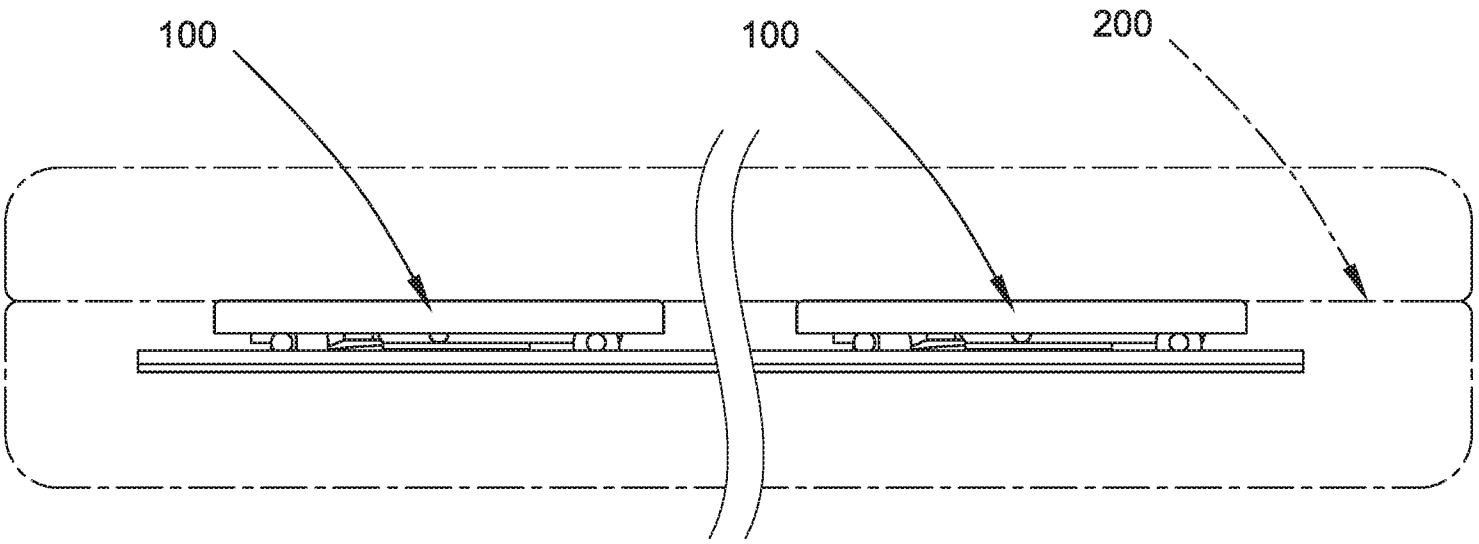
FIG. 8B schematically shows the closed laptop of FIG. 8A.

Referring to FIGS. 8A and 8B, a keyboard 100 in accordance with a second preferred embodiment of the invention is mounted on a housing 200 of a laptop. The transversely moveable board 20 of the first preferred embodiment can be activated by closing or opening the cover of the laptop.

While the invention has been described in terms of preferred embodiments, those skilled in the art will recognize that the invention can be practiced with modifications within the spirit and scope of the appended claims.

What is claimed is:

1. A keyboard comprising:

a base board;

a plurality of transversely moveable boards, each transversely moveable board being moveably provided on the base board and including a film circuit board, a resilient dome on the film circuit board, a hole member on the film circuit board and adjacent to the resilient dome, a plurality of elongated openings on the film circuit board, a hollow structure in the film circuit board and directly under the resilient dome, a top contact in the hollow structure, and a bottom contact in the hollow structure and spaced from the top contact;

a plurality of key caps, each key cap being square and configured to be depressed; and a plurality of scissors-type bridge structures, each scissors-type bridge structure including a first frame member, a hollow, rectangular second frame member, and a peg extending out of the first frame member wherein a top of the scissors-type bridge structure is pivotably secured to the key cap, and a bottom of the scissors-type bridge structure is pivotably secured to the base board by inserting through the elongated holes onto the base board;

wherein in an inoperative state and a first position of the transversely moveable board, the peg is disposed on the resilient dome; and wherein in an operative state by pressing the key cap, the peg presses and moves along the resilient dome to fall into the hole member to cause the transversely moveable board to dispose in a second position.

2. The keyboard of claim 1, wherein the peg extends from a central portion of the first frame member and aligns with both the top contact and the bottom contact, and wherein in response to pressing the key cap, the resilient dome is depressed by the peg, the depressed resilient dome presses the hollow structure to engage the top contact with the bottom contact, thereby generating a key press signal.

3. The keyboard of claim 1, wherein the key cap includes two opposite slide guide grooves on an underside and two pivot grooves on the underside; the scissors-type bridge structure includes a first frame member and a hollow, rectangular second frame member, the first frame member having two first pivots at two corners respectively and pivotably fastened in the slide guide grooves of the key cap respectively, two second pivots at two other corners respectively and pivotably fastened in the snapping grooves of the base board respectively by inserting through the elongated openings, and two holes at intermediate portions of two sides respectively; and the second frame member having a pivot shaft at one end and pivotably mounted between pivot grooves of the key cap, two third pivots at two corners of the other end respectively and pivotably mounted in the slide guide grooves of the base board respectively by inserting through the elongated openings, and two fourth pivots at intermediate portions of two sides respectively and pivotably mounted in the holes respectively.

4. A keyboard comprising:

a base board;

a plurality of transversely moveable boards, each transversely moveable board being moveably provided on the base board and including a film circuit board, a resilient dome on the film circuit board, a hole member on the film circuit board and adjacent to the resilient dome, a plurality of elongated openings on the film circuit board, a hollow structure in the film circuit board and directly under the resilient dome, a top contact in the hollow structure, and a bottom contact in the hollow structure and spaced from the top contact;

a plurality of key caps, each key cap being square and configured to be depressed;

a plurality of scissors-type bridge structures, each scissors-type bridge structure including a first frame member, a hollow, rectangular second frame member, and a peg extending out of the first frame member wherein a top of the scissors-type bridge structure is pivotably secured to the key cap, and a bottom of the scissors-type bridge structure is pivotably secured to the base board by inserting through the elongated holes onto the base board; and a housing for containing the base board, the transversely moveable boards, the key caps, and scissors-type bridge structures;

wherein in an inoperative state and a first position of the transversely moveable board, the peg is disposed on the resilient dome; and wherein in an operative state by pressing the key cap, the peg presses and moves along the resilient dome to fall into the hole member to cause the transversely moveable board to dispose in a second position.

5. The keyboard of claim 4, wherein the peg extends from a central portion of the first frame member and aligns with both the top contact and the bottom contact, and wherein in response to pressing the key cap, the resilient dome is depressed by the peg, the depressed resilient dome presses the hollow structure to engage the top contact with the bottom contact, thereby generating a key press signal.

6. The keyboard of claim 4, wherein the key cap includes two opposite slide guide grooves on an underside and two pivot grooves on the underside; the scissors-type bridge structure includes a first frame member and a hollow, rectangular second frame member, the first frame member having two first pivots at two corners respectively and pivotably fastened in the slide guide grooves of the key cap respectively, two second pivots at two other corners respectively and pivotably fastened in the snapping grooves of the base board respectively by inserting through the elongated openings, and two holes at intermediate portions of two sides respectively; and the second frame member having a pivot shaft at one end and pivotably mounted between pivot grooves of the key cap, two third pivots at two corners of the other end respectively and pivotably mounted in the slide guide grooves of the base board respectively by inserting through the elongated openings, and two fourth pivots at intermediate portions of two sides respectively and pivotably mounted in the holes respectively.

* * * * *